US008967217B2

(12) United States Patent
Gardner et al.

(10) Patent No.: US 8,967,217 B2
(45) Date of Patent: Mar. 3, 2015

(54) HAND-HELD STRAPPER

(75) Inventors: Joseph J. Gardner, Elk Grove Village, IL (US); Janusz Figiel, Mundelein, IL (US); Timothy B. Pearson, Antioch, IL (US)

(73) Assignee: Signode Industrial Group LLC, Glenview, IL (US)

( * ) Notice: Subject to any disclaimer, the term of this patent is extended or adjusted under 35 U.S.C. 154(b) by 410 days.

(21) Appl. No.: 13/355,284

(22) Filed: Jan. 20, 2012

(65) Prior Publication Data

US 2012/0210682 A1 Aug. 23, 2012

Related U.S. Application Data

(60) Provisional application No. 61/445,404, filed on Feb. 22, 2011.

(51) Int. Cl.

| | |
|---|---|
| ***B32B 37/00*** | (2006.01) |
| ***B65B 13/02*** | (2006.01) |
| ***B65B 13/18*** | (2006.01) |
| ***B65B 13/34*** | (2006.01) |

(52) U.S. Cl.

CPC ..... *B65B 13/025* (2013.01); *B65B 13/18* (2013.01); *B65B 13/187* (2013.01); *B65B 13/188* (2013.01); *B65B 13/345* (2013.01)

USPC ..... 156/378; 156/494; 156/579; 100/33 PB

(58) Field of Classification Search

USPC ..... 156/73.5, 229, 361, 378, 494, 495, 579, 156/580; 100/32, 33 PB

See application file for complete search history.

(56) References Cited

U.S. PATENT DOCUMENTS

| | | | | |
|---|---|---|---|---|
| 3,319,666 | A | 5/1967 | Victor et al. | |
| 4,313,779 | A | 2/1982 | Nix | |
| 5,518,043 | A | 5/1996 | Cheung et al. | |
| 5,738,152 | A | 4/1998 | Crittenden | |
| 6,533,013 | B1 * | 3/2003 | Nix | 156/361 |
| 6,732,638 | B1 | 5/2004 | Rometty et al. | |
| 6,907,717 | B2 | 6/2005 | Nix | |
| 6,918,235 | B2 * | 7/2005 | Nix | 53/582 |
| 6,966,255 | B1 | 11/2005 | Crittenden | |
| 7,155,885 | B1 | 1/2007 | Nasiatka et al. | |
| 7,562,620 | B1 | 7/2009 | Nasiatka et al. | |

FOREIGN PATENT DOCUMENTS

| | | |
|---|---|---|
| EP | 0703146 | 3/1996 |
| EP | 1316506 | 6/2003 |
| WO | 2009129634 | 10/2009 |

OTHER PUBLICATIONS

International Search Report for PCT/US2012/026078 dated Aug. 6, 2012.

* cited by examiner

*Primary Examiner* — James Sells
(74) *Attorney, Agent, or Firm* — Levenfeld Pearlstein, LLC

(57) ABSTRACT

A strapping tool for tensioning and securing a strap on or around an object or load includes a motor, a tensioning assembly coupled to the motor, and a weld plate assembly coupled to the motor. The motor is actuated in a first direction to control the tensioning assembly to tension the strap during a tensioning operation and the motor is actuated in a second direction to control the weld plate assembly to weld the strap to itself during a welding operation.

20 Claims, 5 Drawing Sheets

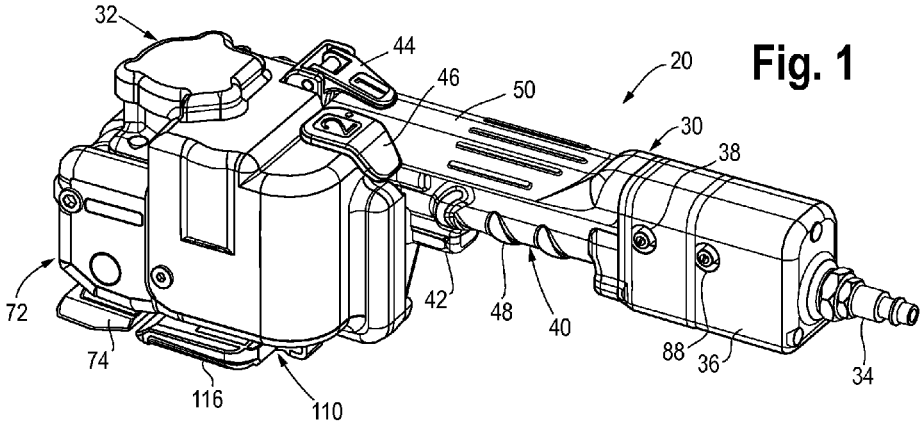
Fig. 1
Fig. 2
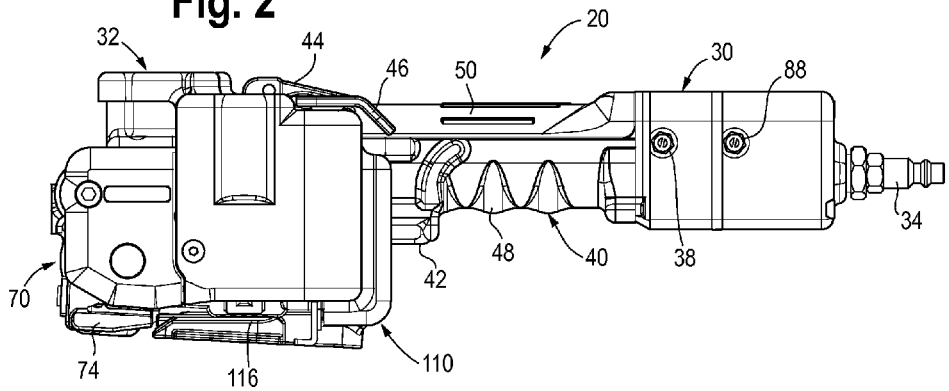
Fig. 3
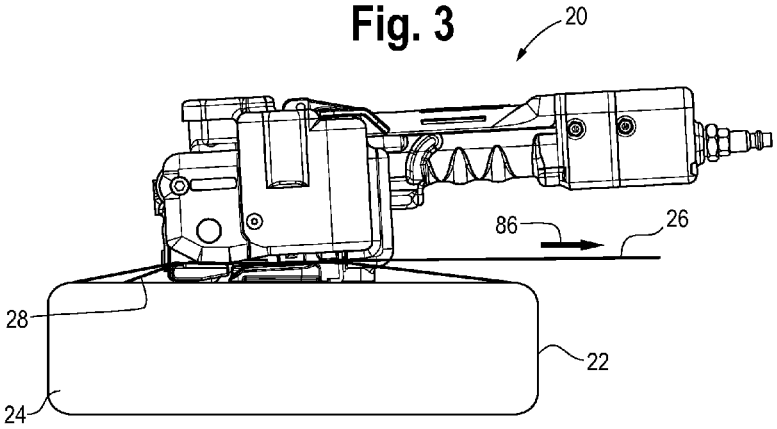

HAND-HELD STRAPPER

CROSS-REFERENCE TO RELATED APPLICATION DATA

This application claims the benefit of priority of Provisional U.S. Patent Application Ser. No. 61/445,404, filed Feb. 22, 2011, the disclosure of which is incorporated herein by reference.

BACKGROUND

Strapping tools or strappers come in a wide variety of types, from completely manual tools to automatic, table-top tools. Strapping tools can be designed and intended for use with different types of strap or strapping materials, such as metal strapping or plastic/polymeric strapping. Strappers for applying plastic or polymeric strapping materials are typically automatic table-top or hand-held devices that are powered to adhere the strap onto itself. The adhering function can be performed by melting or otherwise welding a section of the strap onto itself utilizing ultrasonic or vibrational-type weld assemblies. Such weld assemblies can be powered by electrical, electromechanical, and/or fluid drive (hydraulic or pneumatic) systems.

One known tool disclosed in Nix U.S. Pat. No. 6,907,717, which is incorporated by reference herein, is powered by a pneumatic system that includes first and second pneumatic motors. In the present example, the first pneumatic motor is operatively coupled to a tensioning assembly and the second pneumatic motor is operatively coupled to a weld assembly. Generally, the tensioning assembly includes a feed wheel operatively coupled to the first motor and an anvil foot. The feed wheel and anvil foot are manually separated by a user pulling a housing of the first pneumatic motor upwardly toward a grip. With the feed wheel and anvil foot separated, overlapping strap portions are inserted between the feed wheel and the anvil foot and the housing of the first motor can be released to clamp the strap portions. Thereafter, the first motor can be actuated to rotate the feed wheel and tension the strap. Further, the weld assembly generally includes a weld element operatively coupled to the second motor and a stationary weld pad. Once the strap has been tensioned, the second motor is actuated to vibrate the weld element and seal the overlapping strap portions together.

While the multiple motor tool described generally above has proved to be effective and reliable, there exists a desire for an improved tool that is reliably, easily, and comfortably hand-operated by a user.

SUMMARY

Various embodiments of the present disclosure provide a strapping tool for tensioning and securing a strap on or around an object or load that includes a motor, a tensioning assembly coupled to the motor, and a weld plate assembly coupled to the motor. The motor is actuated in a first direction to control the tensioning assembly to tension the strap during a tensioning operation and the motor is actuated in a second direction to control the weld plate assembly to weld the strap to itself during a welding operation.

Other embodiments of the present disclosure provide a strapping tool that includes a motor, a tensioning assembly coupled to the motor, and an opening assembly coupled to the tensioning assembly. The motor actuates the tensioning assembly to tension overlapping strap portions clamped by the tensioning assembly during a tensioning operation and the opening assembly is actuated to unclamp the overlapping strap portions during a powered opening operation.

Still other embodiments of the present disclosure provide a strapping tool for tensioning and securing a strap that includes a motor, a weld plate assembly coupled to the motor, a tensioning assembly coupled to the motor, an opening assembly coupled to the tensioning assembly, and a pneumatic system coupled to the motor, the weld plate assembly, the tensioning assembly, and the opening assembly. The motor controls the weld plate assembly to weld the strap to itself during a welding operation and the motor controls the tensioning assembly to tension the strap during a tensioning operation. The opening assembly is actuated to unclamp the overlapping strap portions during a powered opening operation. The pneumatic system further includes a compressed gas inlet to the system, a tension pilot valve for controlling a flow of compressed gas to actuate the motor in a first direction during the tensioning operation, a weld pilot valve for controlling a flow of compressed gas to actuate the motor in a second direction and to actuate a piston that forces an upper weld gripper against a lower weld gripper during the welding operation, and an opening valve for controlling a flow of compressed gas to the opening assembly during the powered opening operation.

In this manner, the present disclosure provides an enhanced tool that is reliably, easily, and comfortably hand-operated by a user. Such an improved tool is generally more compact and ergonomic than prior tools and, in one embodiment, may provide a mechanism for unclamping the tool from strapping in a powered operation, as opposed to manually unclamping the tool with a hand operated lever. Further, the tool may include one or more features for preventing operation of the tensioning and weld functions out of order and for minimizing strap jam-up issues.

Other objects, features, and advantages of the disclosure will be apparent from the following description, taken in conjunction with the accompanying sheets of drawings, wherein like numerals refer to like parts, elements, components, steps, and processes.

BRIEF DESCRIPTION OF THE DRAWINGS

FIG. 1 is an isometric view of a strapping tool in accordance with an embodiment of the present disclosure;

FIG. 2 is a left-side elevational view of the strapping tool of FIG. 1;

FIG. 3 illustrates the tool of FIG. 1 positioned relative to a load being strapped;

DETAILED DESCRIPTION

Figure 4:
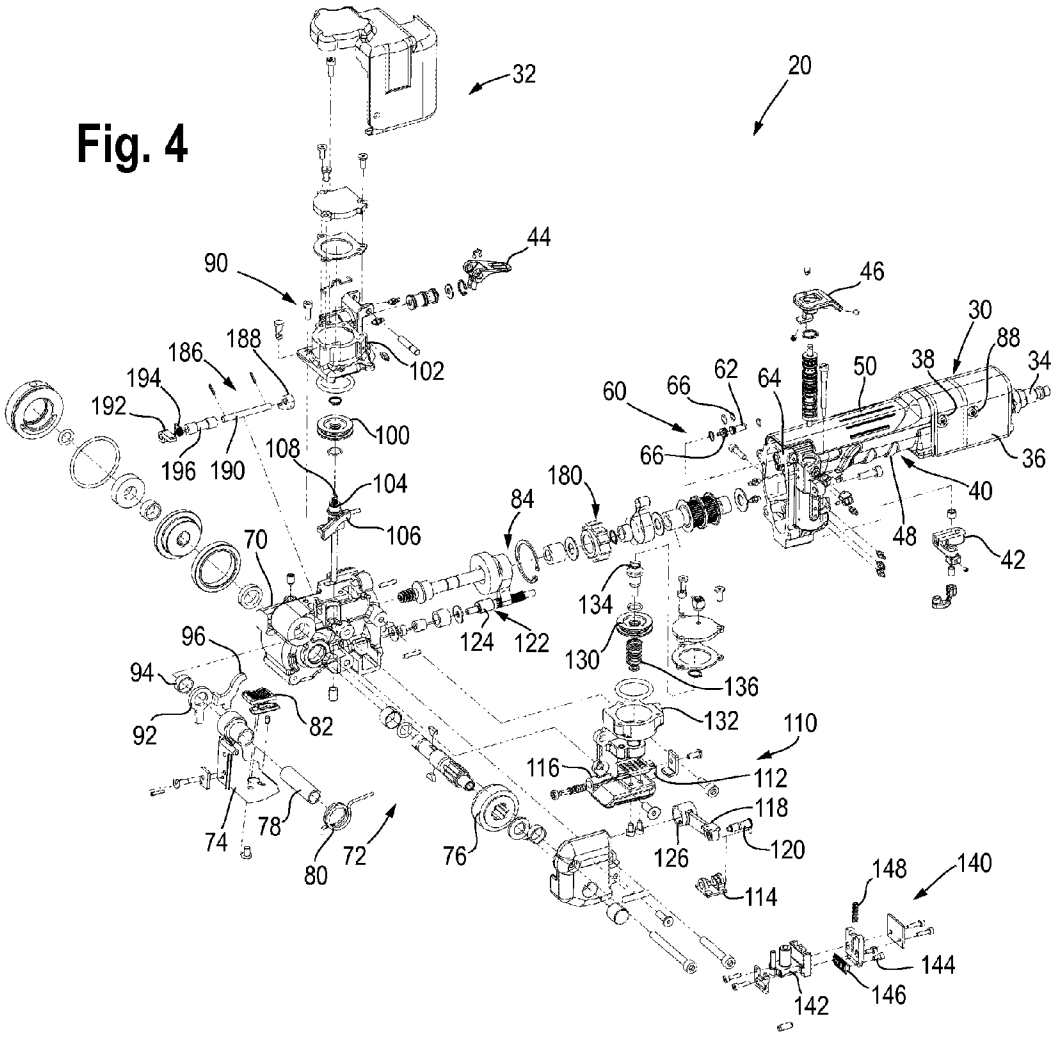
FIG. 4 is an exploded view of the strapping tool of FIG. 1.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to FIGS. 1-7, a strapper or strapping tool 20 in accordance with an embodiment of the present disclosure is shown. The illustrated strapper or strapping tool 20 (sometimes referred to herein as "tool" for brevity) is configured to tension a strap or strapping material 22 around an object or load 24, weld overlapping portions of the strap 22 together, and sever or cut the strap. Generally, the strap 22 includes a feed or supply end 26 and a free end 28 that is fed around the load 24 and reinserted into the tool 20 to overlap the feed end.

The tool 20 includes a motor module assembly 30 operatively coupled to a head assembly 32. The motor module assembly 30 includes a connection 34 for a compressed or pressurized fluid source to drive a motor 36. In one embodiment, the motor 36 is a single reversible air or gas driven motor, the function of which will be described in more detail hereinafter. However, in other examples, the motor 36 can be driven by any other type of hydraulic fluid or may be an electrically driven motor. The motor module assembly 30 includes a mechanism 38 that can be adjusted to change the length of a weld time. In accordance with one example, the mechanism 38 can be an adjustable screw that can be turned by hand or with a screwdriver, for example, to adjust the weld time. Further, the motor module assembly 30 includes a grip 40 for a user to hold the tool 20 and actuate an opening switch 42, a tensioning switch 44, and a welding switch 46.

The opening switch 42 is arranged on a bottom portion 48 of the grip 40 such that when a user grasps the grip with an overhand grip, the opening switch is positioned generally proximate the user's index finger and can be actuated similarly to pulling a trigger, as would be understood by one of ordinary skill. The tensioning switch 44 and the welding switch 46 are arranged on an upper portion 50 of the grip 40 such that when the user grasps the grip, the tensioning and welding switches are positioned generally proximate the user's thumb.

The motor module assembly 30 also includes a weld switch lockout assembly 60 coupled thereto. The weld switch lockout assembly 60 is actuated to prevent the welding switch 46 from being depressed out of order with the opening switch 42 and the tensioning switch 44. In accordance with the present example, the weld switch lockout assembly 60 includes a weld lockout piston 62 disposed within a lockout cylinder 64. The weld lockout piston 62 is extended and retracted from the lockout cylinder 64 to prevent and allow, respectively, the welding switch 46 from being depressed, as will be described in more detail hereinafter. Interference or seal members 66, such as o-rings, are disposed on the weld lockout piston 62 and interact with the lockout cylinder 64 to hold the piston in place when the piston is extended and retracted.

The head assembly 32 of the tool 20 includes a gripper housing assembly 70 and a tensioning assembly 72 mounted to the gripper housing assembly. The tensioning assembly 72 includes a tensioner foot assembly 74 and a feed wheel 76. The tensioner foot assembly 74 is pivotally mounted about a pivot pin 78 to the gripper housing assembly 70 so that the foot assembly 74 can pivot toward and away from the feed wheel 76. A biasing element 80, such as a torsion spring, is further disposed over the pivot pin 78 and is configured to bias the tensioner foot assembly 74 in a first position against the feed wheel 76, as shown generally in FIG. 5. More particularly, the tensioner foot assembly 74 includes a gripper plug 82 that is biased against the feed wheel 76 by the biasing element 80 in the first position.

The feed wheel 76 is rotatably mounted to the gripper housing assembly 70 and is operatively coupled to a feed wheel drive gear assembly 84. The feed wheel drive gear assembly 84 is further operatively coupled to the motor 36, which is actuated in a first direction, for example, a clockwise direction, to rotate the gear assembly 84 and the feed wheel 76. In accordance with one example, when overlapping portions of strap 22 are clamped between the gripper plug 82 and the feed wheel 76 and the motor 36 is actuated in the first direction, the feed wheel rotates and tensions the strap by driving the feed end 26 of the strap in the direction indicated by an arrow 86 in FIG. 3.

The illustrated tool 20 also includes a mechanism 88 that can be adjusted to change the maximum tension drawn by the feed wheel 76. In accordance with one example, the mechanism 88 can be an adjustable screw that can be turned by hand or with a screwdriver, for example, to adjust the size of a compressed gas flow passage to the motor 36 and, thus, to adjust the revolutions-per-minute of the motor and a stall out tension of the feed wheel 76.

Figure 5:
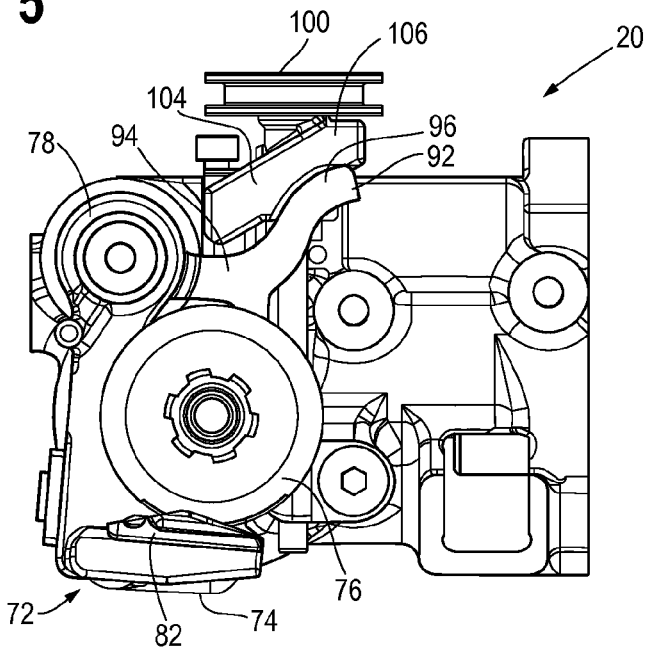
FIG. 5 is an enlarged left-side elevational view similar to FIG. 2 with portions of the strapping tool removed to illustrate an opening assembly in a first position.

In accordance with the present example, the tool 20 also includes an opening assembly or mechanism 90 that performs a powered opening operation when the opening switch 42 is depressed. The opening assembly 90 is shown more clearly in FIGS. 4-6 and includes a foot lever 92 coupled to the tensioner foot assembly 74, such as at the pivot pin 78. When the tensioner foot assembly 74 is in a first position or stage, as seen in FIG. 5, the foot lever 92 has a proximate portion 94 that extends generally horizontally away from the lever and a distal portion 96 that extends generally angularly away from the proximate portion. In the present example, the distal portion 96 curves upwardly away from the proximate portion 94. Alternatively, the distal portion 96 may extend linearly, angularly away from the proximate portion 94.

Figure 6:
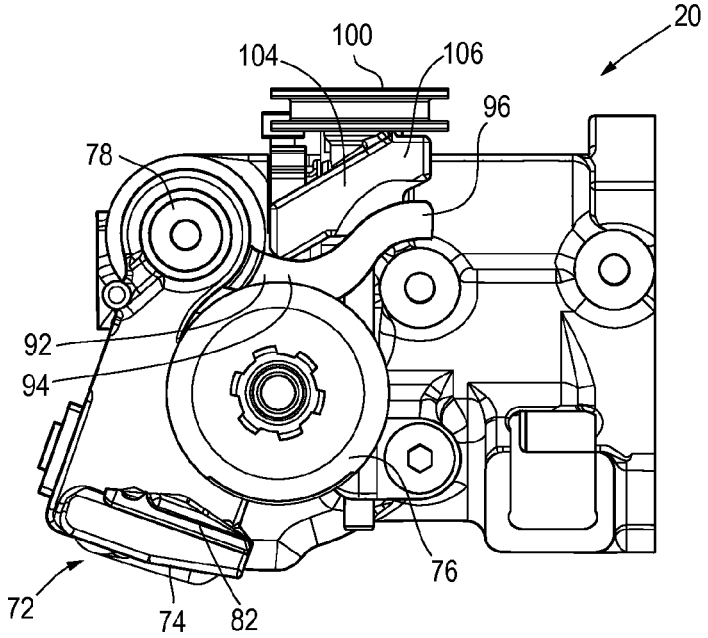
FIG. 6 is an enlarged left-side elevational view similar to FIG. 5 with the opening assembly in a second position.

The opening assembly 90 is actuated by movement of a first piston 100 disposed within a first piston chamber 102 coupled to the gear housing assembly 70. In the present example, a first piston rod 104 with an inclined plane member 106 is coupled to the first piston 100, such that actuation of the first piston downwardly in the first piston chamber 102 drives the first piston rod downwardly from the first position, as seen in FIG. 5, to a second position or stage, as seen in FIG. 6. An extension spring 108 disposed between the piston rod 104 and the first piston 100 biases the piston rod and piston upwardly to the first position.

In one example of the opening assembly 90 in use, the first piston 100 is driven downwardly, such as by routing compressed gas into the first piston chamber 102. The downward movement of the first piston 100 engages and drives the inclined plane member 106 of the piston rod 104 downward. The inclined plane member 106 contacts the distal portion 96 of the foot lever 92 in the first position, as shown in FIG. 5, and exerts a maximum opening force to push the tensioner foot assembly 74 and the gripper plug 82 away from the feed wheel 76. The first piston 100 is further driven downward so that the inclined plane member 106 of the piston rod 104 contacts the proximate portion 94 of the foot lever 92, as shown in FIG. 6, to rotate the tensioner foot assembly 74 and the gripper plug 82 away from the feed wheel 76 and provide maximum clearance for inserting and removing the strap 22.

The head assembly 32 further includes a weld plate assembly 110 mounted to the gripper housing assembly 70. The weld plate assembly 110 includes a lower weld gripper 112 and an upper weld gripper 114. In the present example, the weld plate assembly 110 includes a foot 116 and the lower weld gripper 112 is held stationary with respect to the weld plate assembly 110 on the foot. The upper weld gripper 114 is coupled to a linkage arm 118, such as by a pivot pin 120, and the linkage arm is operatively coupled to a weld plate drive gear assembly 122. In the present example, the weld plate drive gear assembly 122 includes an eccentric shaft 124 that is disposed within a generally circular opening 126 defined in the linkage arm 118. The weld plate drive gear assembly 122 is further operatively coupled to the motor 36, which is actuated to rotate the weld plate drive gear assembly. Rotation of the weld plate drive gear assembly 122 causes the eccentric shaft 124 to rotate within the circular opening 126 in the linkage arm 118, thereby causing an oscillating vibration of the upper weld gripper 114.

In one example, actuation of the motor 36 in the first direction (e.g., the clockwise direction) or in a second direction (e.g., a counterclockwise direction) causes the weld plate drive gear assembly 122 and the eccentric shaft 124 to rotate, thereby causing the upper weld gripper 114 to vibrate. However, the weld operation is only performed when the upper weld gripper 114 is vibrating and being forced against the lower weld gripper 112.

In accordance with the illustrated embodiment, the weld plate assembly 110 includes a second piston 130 disposed within a second piston chamber 132, wherein the second piston is actuated to force the upper weld gripper 114 against the lower weld gripper 112. More particularly, a second piston rod 134 is coupled to the second piston 132, such that actuation of the second piston drives the second piston rod downwardly against the linkage arm 118 to force the upper weld gripper 114 against the lower weld gripper 112. The force of the upper weld gripper 114 against the lower weld gripper 112 and the vibration of the upper weld gripper welds overlapping portions of strap 22 together. A biasing element 136, such as a spring, is further disposed within the second piston chamber 130 to bias the second piston 132 and the piston rod 134 away from the linkage arm 118 until the second piston is actuated to perform the weld operation. In one example, the actuation of the second piston 132 to force the upper weld gripper 114 against the lower gripper 112 corresponds with the actuation of the motor 36 in the second direction, for example the counterclockwise direction, to perform the weld operation.

In addition, a cutting assembly 140 is coupled to the weld plate assembly 110 to cut the strap 22. More particularly, the cutting assembly 140 includes a contact plate 142 coupled to a cutter insert holder 144. A cutter 146 is further coupled to the cutter insert holder 144 and the contact plate 142 is mounted to the second piston 132 to move downwardly onto the feed end 26 of the strap 22 along with the linkage arm 118 and the upper weld gripper 114. The cutting assembly 140 includes a spring 148 so that the cutter 146 is allowed to float within the cutter insert holder 144 to assure that the top feed end 26 of the strap 22 is cut and the free end 28 of the strap is not cut.

Figure 7:
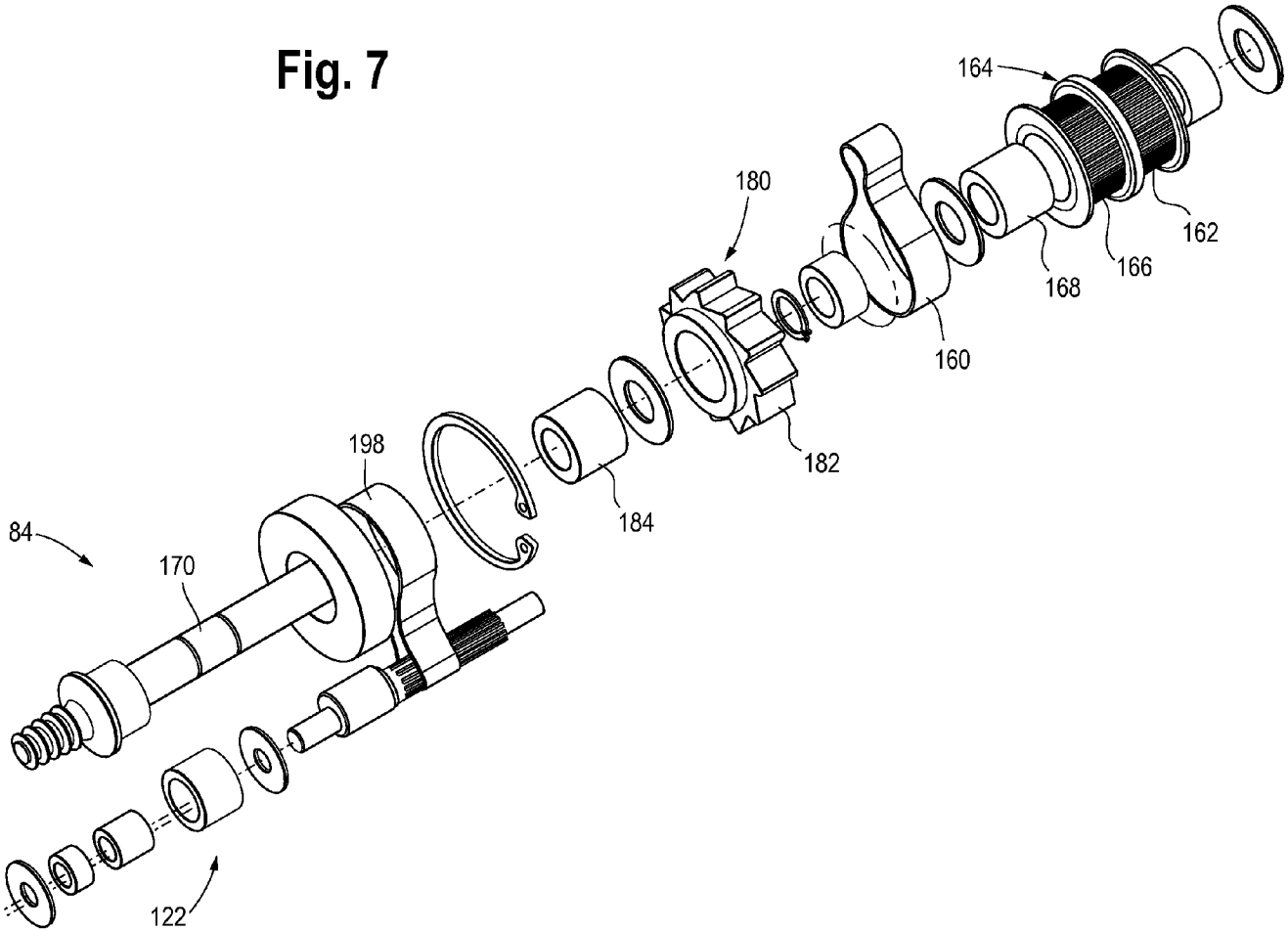
FIG. 7 is an enlarged exploded view of a feed wheel drive gear assembly and a weld plate drive gear assembly of the tool of FIG. 1.

Referring now to FIG. 7, the feed wheel and the weld plate drive gear assemblies 84, 122 include various components to allow the motor 36, which can be a single reversible motor, to drive both assemblies. In the present example, the feed wheel drive gear assembly 84 includes a drive belt 160 coupled to the motor 36, such as to a drive shaft (not shown) of the motor, as would be apparent to one of ordinary skill in the art. The drive belt 160 is further coupled to a first wheel 162 of a pulley assembly 164. The motor 36 is actuated to drive the drive belt 160 and rotate the first wheel 162 and a second wheel 166 of the pulley assembly 164. A roller clutch 168 is disposed within the pulley assembly 164 and is coupled to a drive shaft or pinion 170, such as a spiroid pinion. When the motor 36 is actuated in the first direction, the drive belt 160 rotates the pulley assembly 164 in the first direction and the roller clutch 168 engages the pinion 170 to rotate same. When the motor 36 is actuated in the second direction, the drive belt 160 rotates the pulley assembly 164 in the second direction but the roller clutch 168 disengages from the pinion 170 and freewheels around the pinion. The pinion 170 is further coupled to rotate the feed wheel 76 to perform the tensioning operation.

A brake assembly 180 is further coupled to the feed wheel drive gear assembly 84 to prevent the feed wheel 76 from reversing direction and releasing tension from the clamped strap 22 until the opening switch 42 is depressed. In accordance with the present example, the brake assembly 180 includes a toothed brake wheel 182 coupled to the pinion 170 by a second roller clutch 184. The second roller clutch 184 engages the pinion 170 when same is rotated in the second direction and disengages from the pinion when same is rotated in the first direction. The brake assembly 180 further includes a pawl assembly 186 that is coupled to the gear housing assembly 70. In the present example, the pawl assembly 186 includes a pawl 188 disposed on a first end of a brake pin 190 and a brake lever 192 disposed on a second opposing end of the brake pin. A brake spring 194 and a brake roller 196 are further coupled to the brake pin 190. The brake spring 194 biases the pawl assembly 186 so that the pawl 188 is engaged with the toothed brake wheel 182 to prevent same from rotating in the second direction and allowing tension to be released from the strap 22.

When the opening switch 42 is depressed and the opening assembly 90 actuated, the opening assembly interacts with the pawl assembly 186 to disengage the brake wheel 182 and allow the pinion 170 to rotate in the second direction. The rotation of the pinion 170 in the second direction allows the feed wheel 76 to reverse direction and release tension from the strap 22, which can then be more easily removed from the strapper 20. In one example, when the opening assembly 90 is actuated, the first piston rod 104 is driven downward and engages the brake lever 192, which in turn rotates the pawl 188 out of engagement with the brake wheel 182.

The weld plate drive gear assembly 122 further includes a weld belt 198 that is coupled the second wheel 166 of the pulley assembly 162 and to the eccentric shaft 124. The motor 36 is actuated in the first or second directions to drive the drive belt 160, which rotates the pulley assembly 164 and drives the weld belt 198. Driving the weld belt 198 rotates the eccentric shaft 124 and causes the upper weld gripper 114 to vibrate. In the present example, the upper weld gripper 114 vibrates when the motor 36 is actuated in the first or second directions. However, the vibration of the upper weld gripper 114 does not weld overlapping portions of the strap 22 together until the second piston 130 is actuated to force the upper weld gripper 114 against the lower weld gripper 112, as described above.

The feed wheel and the weld plate drive gear assemblies 84, 122 may include fewer or additional components, as would be apparent to one of ordinary skill in the art. For example, the assemblies 84, 122 may include various washers, spacers, bearings, retention rings, etc., without departing from the spirit and scope of the present disclosure.

Figure 8:
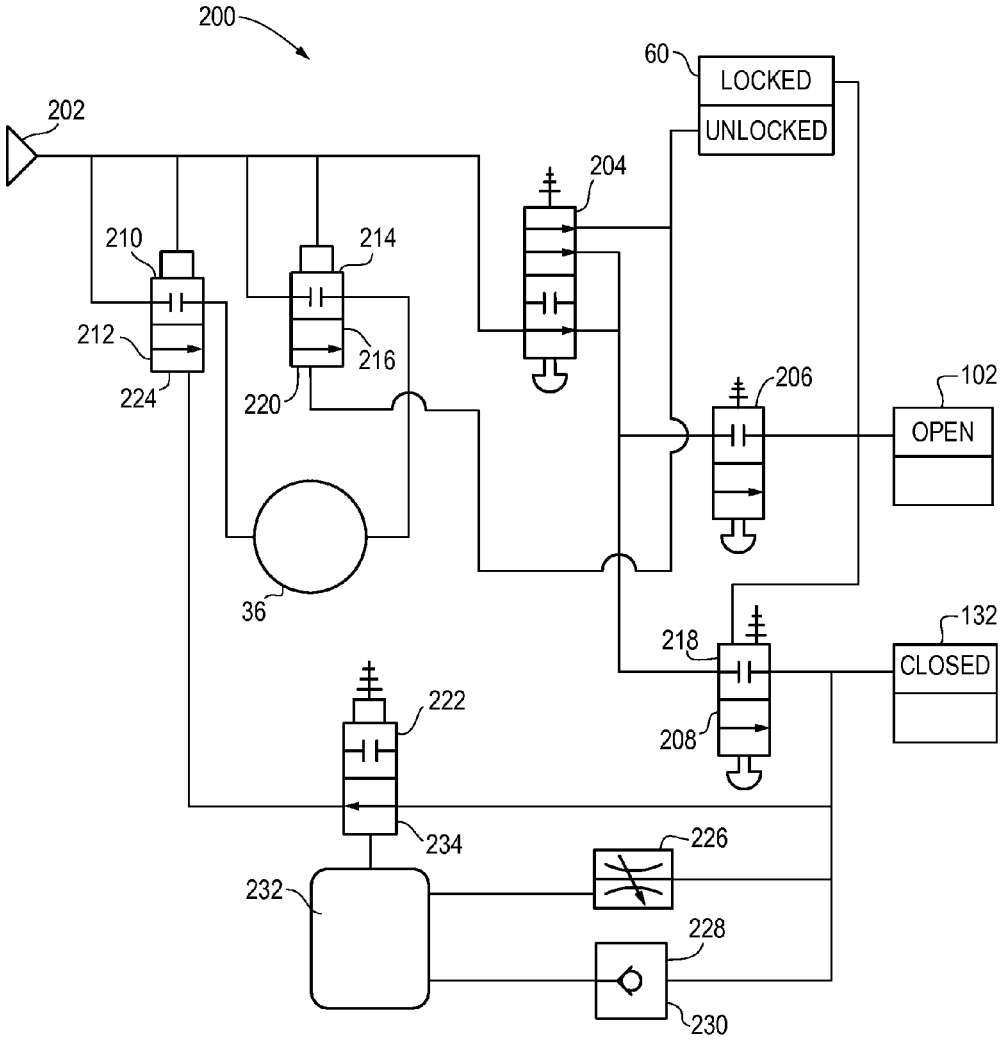
FIG. 8 is a pneumatic circuit diagram of a strapping tool, such as the tool of FIG. 1, in accordance with an embodiment of the present disclosure.

Referring now to the pneumatic circuit or module 200 of FIG. 8, gas is supplied to the tool 20 through a compressed gas supply 202 and enters a tension pilot valve 204, which is normally biased in an off or closed position. In the illustrated circuit, the tension pilot valve 204 is configured to supply a continuous flow of gas, regardless of whether the tension pilot valve is off or on, to an opening valve 206 and a weld pilot valve 208. The tension pilot valve 204 may be any suitable valve, such as a 3 or 4 port and 2 position valve, as would be apparent to one of ordinary skill in the art. The opening valve 206 and the weld pilot valve 208 are both normally biased in off positions, as shown in FIG. 8. The opening valve 206 and the weld pilot valve 208 are also shown generally back-to-back in FIG. 4. Gas from the compressed gas supply 202 is also routed to a back side 210 of a seal valve 212 and a back side 214 of a tension valve 216 to bias the seal valve and the tension valve in off or closed positions, as shown.

Depression or actuation of the opening switch 42 moves the opening valve 206 to an on or open position, which routes gas to the first piston chamber 102 to separate and open the tensioner foot assembly 74 and the gripper plug 82 from the feed wheel 76 so that the strap 22 can be inserted or removed therefrom, as described above. Once the strap 22 is inserted or removed, the opening switch 42 can be released and the opening valve 206 returned to the off position so that gas is no longer routed to the first piston chamber 102 and the biasing element 80 is allowed to bias the tensioner foot assembly 74 and the gripper plug 82 back against the feed wheel 76.

Moving the opening valve 206 to the on position also routes gas to a back side 218 of the weld pilot valve 208 to force the pilot valve to the off position and to ensure that the welding switch 46 is not depressed. Simultaneously therewith, gas is routed to the weld switch lockout assembly 60 to extend the weld lockout piston 62, which engages and prevents depression of the welding switch 46.

With the strap 22 gripped between the gripper plug 82 and the feed wheel 76, a user can depress or actuate the tensioning switch 44 to move the tension pilot valve 204 to an on or open position, which routes gas to a front side 220 of the tension valve 216 to move the tension valve to an on position. When the tension valve 216 is in the on position, gas is routed from the gas supply 202 through the tension valve to the motor 36 to actuate the motor in the first direction. The actuation of the motor 36 in the first direction rotates the feed wheel drive gear assembly 84 and causes the feed wheel 76 to rotate and tension the strap 22. Generally, the strap 22 is being tensioned around a load 24 and the motor 36 will stall out when a maximum amount of tension is drawn by the feed wheel 76. However, the tension switch 44 may be held down as long as desired and can be released at any time before the maximum tension is drawn. Further, as discussed above, the mechanism 88 can be coupled to the motor 36 to adjust a flow of compressed gas to the motor and, thus, adjust the maximum tension at stall out.

Actuation of the tension pilot valve 204 to the on position also routes gas to the weld switch lockout assembly 60 to retract the weld lockout piston 62 and allow the weld switch 46 to be depressed. Consequently, the weld operation cannot be initiated out of order with the tensioning operation.

Depression or actuation of the weld switch 46 moves the weld pilot valve 208 to an on or open position, which routes gas to the second piston chamber 132 to force the upper weld gripper 114 against the lower weld gripper 112. Actuation of the weld pilot valve 208 to the on position also routes gas to a weld shut-off valve 222. The weld shut-off valve 222 is normally biased in an on or open position so that gas routed thereto is further routed to a front side 224 of the seal valve 212 to move the seal valve to an on or open position. When the seal valve 212 is in the on position, gas is routed from the gas supply 202 to the motor 36 to actuate the motor in the second direction. The actuation of the motor 36 in the second direction rotates the weld plate drive gear assembly 122 and causes the upper weld gripper 114 to vibrate and weld the strap 22, as discussed above.

Actuation of the weld pilot valve 208 to the open position also routes gas to a weld timer valve 226 and a back side 228 of a check valve 230. In one example, the weld timer valve 226 is a variable orifice valve that regulates a flow rate of gas to a timing chamber or accumulator 232. The regulated flow of gas through the weld timer valve 226 increases the pressure in the timing chamber 232 over time, thus providing a timing function. Gas from the timing chamber 232 is routed to a front side 234 of the weld shut-off valve 222 as the pressure increases in the timing chamber. When the pressure in the timing chamber 232 reaches a predetermined pressure, the gas routed to the front side 234 of the weld shut-off valve 222 causes the weld shut-off valve to close, thus stopping or isolating the gas flow to the seal valve 212 and stopping rotation of the motor 36 in the second direction and vibration of the upper weld gripper 114. The mechanism 38, discussed above, can be coupled to the weld timer valve 226 to adjust the flow rate and, thus, adjust the weld time.

In the present example, once the weld switch 46 is depressed and the weld pilot valve 208 moved to the open position, the weld pilot valve remains biased in the open position. The weld pilot valve 208 does not return to the off or closed position until the opening switch 42 is again depressed or actuated. When the opening switch 42 is again depressed, the opening valve 206 is moved to the open position and gas is rotated to the back side 218 of the weld pilot valve 208 to move the weld pilot valve to the closed position. With the weld pilot valve 208 in the closed position, gas is no longer routed to the back side 228 of the check valve 230 and gas is allowed to vent from the timing chamber 232 through the check valve. Thereafter, the opening, tensioning, and welding operations can be repeated, as described above.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A strapping tool for tensioning and securing a strap, comprising:

a compressed gas powered motor;

a tensioning assembly coupled to the motor;

a weld plate assembly coupled to the motor; and a weld time adjusting mechanism, wherein the motor is actuated in a first direction to control the tensioning assembly to tension the strap during a tensioning operation, wherein the motor is actuated in a second direction to control the weld plate assembly to weld the strap to itself during a predetermined weld time during a welding operation, and wherein the weld time adjusting mechanism is configured to change a length of the predetermined weld time.

2. The strapping tool of claim 1, wherein the tensioning assembly includes a feed wheel coupled to the motor by a drive gear assembly, wherein when the motor is actuated in the first direction, the drive gear assembly rotates the feed wheel to tension the strap, and when the motor is actuated in the second direction, the motor does not rotate the feed wheel.

3. The strapping tool of claim 2, wherein the drive gear assembly includes a pinion coupled to the feed wheel to rotate same, wherein the motor is coupled to the pinion by a roller clutch that engages the pinion when the motor is actuated in the first direction and disengages from the pinion when the motor is actuated in the second direction.

4. The strapping tool of claim 3, wherein the drive gear assembly is coupled to the motor by a drive belt, which is coupled to a pulley assembly, and wherein the pulley assembly is coupled to the pinion by the roller clutch, further wherein a weld belt is coupled to the pulley assembly and further coupled to an eccentric shaft coupled to the weld plate assembly.

5. The strapping tool of claim 3, further comprising a brake assembly coupled to the drive gear assembly for preventing the pinion from rotating in the second direction when the brake assembly is engaged.

6. The strapping tool of claim 5, wherein the brake assembly includes a toothed wheel that is coupled to the pinion by a second roller clutch that engages the pinion when the pinion is rotated in the second direction and disengages from the pinion when the pinion is rotated in the first direction.

7. The strapping tool of claim 6, wherein the brake assembly is engaged and disengaged by a pawl assembly, and wherein the pawl assembly is normally biased to engage the brake assembly and is actuated to disengage the brake assembly by an opening assembly during a powered opening operation.

8. The strapping tool of claim 1, wherein the weld plate assembly includes a lower weld gripper, an upper weld gripper coupled to the motor by a drive gear assembly, and a piston assembly, wherein during the welding operation, the piston assembly is actuated to force the upper weld gripper against the lower weld gripper and the motor is actuated in the second direction to drive the drive gear assembly to vibrate the upper weld gripper, and during the tensioning operation the motor is actuated in the first direction to drive the gear assembly and vibrate the upper weld gripper but the piston assembly is not actuated to force the upper weld gripper against the lower weld gripper.

9. The strapping tool of claim 1, further comprising an opening assembly that is actuated to unclamp the strap during a powered opening operation, wherein the powered opening operation is performed upon actuation of an opening switch, the tensioning operation is performed upon actuation of a tensioning switch, and the welding operation is performed upon actuation of a welding switch.

10. The strapping tool of claim 9, further comprising a housing with a grip, wherein the opening switch is positioned on a bottom portion of the grip and the tensioning switch and the welding switch are positioned on a top portion of the grip.

11. The strapping tool of claim 9, further comprising a weld switch lockout assembly that engages the weld switch to prevent actuation thereof when the opening switch is actuated and disengages the weld switch to allow actuation thereof when the tensioning switch is actuated.

12. A strapping tool, comprising:

a motor;

a tensioning assembly coupled to the motor; and an opening assembly coupled to the tensioning assembly, wherein the motor actuates the tensioning assembly to tension overlapping strap portions clamped by the tensioning assembly during a tensioning operation, and wherein the opening assembly is actuated to unclamp the overlapping strap portions during a powered opening operation.

13. The strapping tool of claim 12, wherein the tensioning assembly includes a gripper plug movably mounted with respect to a feed wheel, wherein the gripper plug and the feed wheel are configured to clamp the overlapping strap portions therebetween, and wherein the opening assembly is actuated to move the gripper plug away from the feed wheel during the powered opening operation.

14. The strapping tool of claim 13, further comprising a tensioner foot assembly that is pivotally mounted with respect to the feed wheel and a foot lever coupled to the tensioner foot assembly, wherein the gripper plug is mounted to the tensioner foot assembly and the opening assembly engages the foot lever to rotate the tensioner foot assembly and gripper plug away from the foot lever.

15. The strapping tool of claim 14, wherein the opening assembly engages the foot lever in a two stage process to push and rotate the gripper plug away from the feed wheel.

16. The strapping tool of claim 15, wherein the foot lever includes a proximate portion and a distal portion that extends generally angularly away from the proximate portion, wherein the opening assembly engages the distal portion during a first stage of the two stage process and engages the proximate portion during a second stage of the two stage process.

17. The strapping tool of claim 14, wherein the opening assembly includes a piston assembly that is actuated by compressed gas to engage the foot lever during the powered opening operation.

18. The strapping tool of claim 17, wherein the piston assembly includes a piston chamber, a piston disposed within the piston chamber, and a piston rod with an inclined plane coupled to the piston, and wherein the piston is actuated within the piston chamber so that the inclined plate engages the foot lever during the powered opening operation.

19. A strapping tool for tensioning and securing a strap, comprising:

a motor;

a weld plate assembly coupled to the motor;

a tensioning assembly coupled to the motor;

an opening assembly coupled to the tensioning assembly; and a pneumatic system coupled to the motor, the weld plate assembly, the tensioning assembly, and the opening assembly, wherein the motor controls the weld plate assembly to weld the strap to itself during a welding operation, wherein the motor controls the tensioning assembly to tension the strap during a tensioning operation, wherein the opening assembly is actuated to unclamp the overlapping strap portions during a powered opening operation, and wherein the pneumatic system further includes a compressed gas inlet to the system, a tension pilot valve for controlling a flow of compressed gas to actuate the motor in a first direction during the tensioning operation, a weld pilot valve for controlling a flow of compressed gas to actuate the motor in a second direction and to actuate a piston that forces an upper weld gripper against a lower weld gripper during the welding operation, and an opening valve for controlling a flow of compressed gas to the opening assembly during the powered opening operation.

20. The strapping tool of claim 19, wherein the weld pilot valve is further coupled to a weld timer valve that regulates a flow of compressed gas to a timing chamber configured to isolate gas flow to the motor upon reaching a predetermined pressure in the chamber, and wherein the opening valve is further configured to route a flow of compressed gas to the weld pilot valve to deactuate same and to a weld switch lockout assembly to prevent actuation of the weld pilot valve, further wherein the tension pilot valve is further configured to route a flow of compressed gas to the weld switch lockout assembly to allow actuation of the weld pilot valve.

* * * * *